United States Patent [19]

Hart

[11] 4,165,678

[45] Aug. 28, 1979

[54] PAPER LOG FORMING APPARATUS

[76] Inventor: John M. Hart, P.O. Box 13646, San Antonio, Tex. 78213

[21] Appl. No.: 844,614

[22] Filed: Oct. 25, 1977

[51] Int. Cl.[2] ..... B31C 1/00

[52] U.S. Cl. ..... 93/1 C; 93/59 CE; 93/81 R; 242/67.1 R

[58] Field of Search ..... 93/1 C, 59 CE, 81 R; 242/67.1 R, 67.3 R, 68, 72

[56] References Cited

U.S. PATENT DOCUMENTS

| | | | |
|---|---|---|---|
| 2,682,924 | 7/1954 | Lomazzo et al. | 242/72 |
| 3,137,451 | 6/1964 | Spanke | 93/81 R X |
| 3,840,195 | 10/1974 | Zebny | 242/72 R |
| 3,936,007 | 2/1976 | Butz | 93/1 C X |
| 3,958,499 | 5/1976 | Albee, Jr. | 93/1 C |
| 3,964,373 | 6/1976 | Christen, Jr. et al. | 93/1 C |
| 4,068,564 | 1/1978 | Dahlstrom | 93/1 C |

*Primary Examiner*—Howard N. Goldberg
*Attorney, Agent, or Firm*—Gunn & Lee

[57] ABSTRACT

An apparatus for rolling newspapers or the like into logs for burning is shown. A foot-operated electric motor is securely mounted on a work surface. Connected to the motor and parallel to the work surface is a rectangular shaft removeably supported on the opposite end thereof. The rectangular shaft has two longitudinally tapered halves slideable along the taper therebetween to reduce the effective cross-sectional diameter of the rectangular shaft. By turning the motor ON and supplying paper to the rectangular shaft, the paper is wrapped and periodically taped into position. After a paper log is formed, a prying device anchored to the work surface slideable moves one of the tapered halves with respect to the other tapered half along the taper therebetween. The movement reduces the cross-sectioned diameter of the rectangular shaft thereby releasing the paper log formed thereon. The paper log is slid to the left and removed from the rectangular shaft as a spring loaded hinge pivots out of the way.

12 Claims, 5 Drawing Figures

PAPER LOG FORMING APPARATUS

BACKGROUND OF THE INVENTION

The present invention relates to a paper log forming apparatus and, more particularly, to a motorized apparatus having a rectangular shaft extending therefrom. The rectangular shaft has longitudinally tapered halves slideable with respect to each other along the taper therebetween to reduce the cross-sectional area of the rectangular shaft thereby allowing easy removal of paper logs formed on the rectangular shaft.

BRIEF DESCRIPTION OF THE PRIOR ART

Prior to the present invention, many different types of newspaper or other paper log rolling apparatuses have been developed in the past. A typical such paper log roller is shown in U.S. Pat. No. 3,964,373 which has a stationary frame in which paper logs may be formed. After the paper logs are formed on a shaft, the shaft and handle are moved along the center axis of the paper log formed thereon so that the paper log may be removed. Such an apparatus is time consuming to use and is not economically feasible for producing a large volume of paper logs.

Other types of very simplified manual devices have been used for making paper logs out of newspapers, such as U.S. Pat. No. 3,958,499 to Albee. However, the Albee patent does not form a tight paper log that is essential for a long duration burn of the paper log. Further, the newspaper log roller as shown in Albee is not suited for high speed production of paper logs.

A somewhat more complicated paper log roller is shown in U.S. Pat. No. 3,936,007 issued to Butz, which patent utilizes a spring loaded spindle to tightly wind the paper thereon.

With the increased cost of wood as a source of combustion primarily for home usage, considerable attention has been given to alternative forms of combustible material. Paper, which is a wood derivative, is easily combustible, but is normally thrown away after a period of time. By rolling paper into tight paper logs, it has been found that paper may provide a good source of combustion for home heating. However, prior attempts in forming paper logs have been impractical for an economic, high volume operation producing large numbers of paper logs.

SUMMARY OF THE INVENTION

It is an object of the present invention to provide a paper log rolling apparatus.

It is another object of the present invention to provide an apparatus on which newspapers may be wrapped by the rotation of an axis.

It is yet another object of the present invention to provide an apparatus having a rotating shaft turned by a foot-operated motor for wrapping sheet material thereon. The axis is formed from two longitudinally tapered halves to form a basically rectangular shaft. By pushing against the first of the longitudinally tapered halves, it will slide along the longitudinal axis of the rectangular shaft for a predetermined distance to reduce the effective cross-sectional area of the rectangular shaft.

As the sheet material, such as newspapers, is wound on the rectangular shaft, the newspapers are periodically taped into position to insure a tight roll. A first end of the rectangular shaft is attached to the motor, and the second end of the rectangular shaft is removeably supported by a pivotable structure. By pushing against a flanged member at the first end of the rectangular shaft, the first of the longitudinally tapered halves is slid along the taper to reduce the cross-sectional area of the rectangular shaft. Thereafter, the rolled paper log can be easily slid off of the second end of the rectangular shaft. The flanged portion at the first end is returned to its original position, along with the first longitudinally tapered half. A threaded shank on the second longitudinally tapered half in conjunction with a nut thereon may be used to aid in moving the first longitudinally tapered half to reduce the effective cross-sectional area of the rectangular shaft as previously described.

For a quick release of the paper log, a prying member is pivotal anchored below the rectangular shaft. After the paper log is formed, by a simple pivotal movement of the prying member, the first longitudinally tapered half is moved to the left and the paper log is released. Thereafter, the paper log is slid off the second end of the rectangular shaft, while simultaneously pivoting a spring-loaded hinge away from the second end of the rectangular shaft. Tape dispensers are anchored to a work surface and located immediately adjacent to the rectangular shaft for supplying tape at the fingertips of the operator to hold the paper log together.

DESCRIPTION OF THE PREFERRED EMBODIMENT

Figure 1:
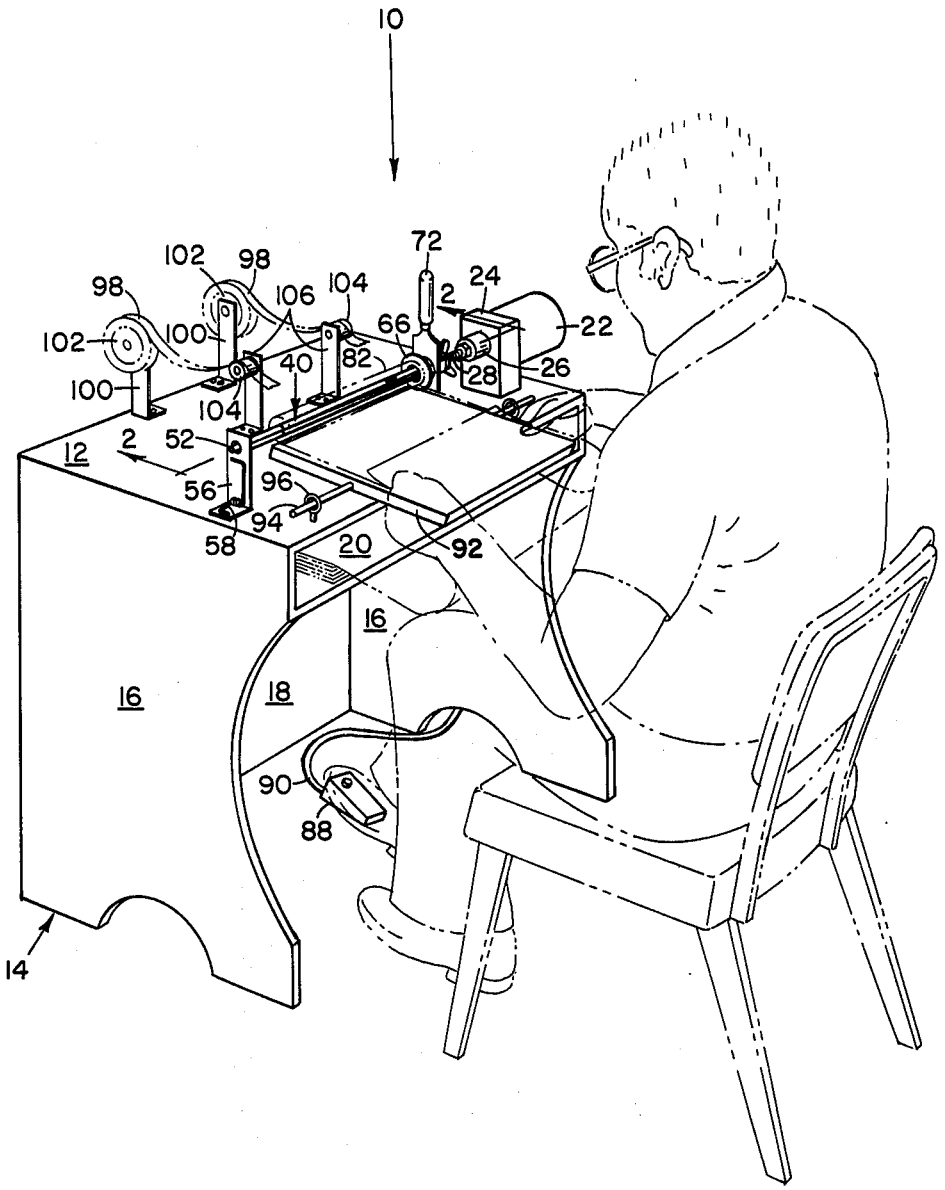
FIG. 1 is a pictorial perspective view showing a paper log forming apparatus in use.

Referring to FIG. 1 of the drawings, there is shown a paper log forming apparatus represented generally by reference numeral 10. The paper log forming apparatus 10 is mounted on a work surface, such as top 12 of a work desk 14. While mounting on work desk 14 is not essential, such a work desk may include side walls 16 and back supporting structure 18. Immediately below the top 12 is a storage shelf 20 that may be used to store paper being rolled on the paper log forming apparatus 10.

Figure 2:
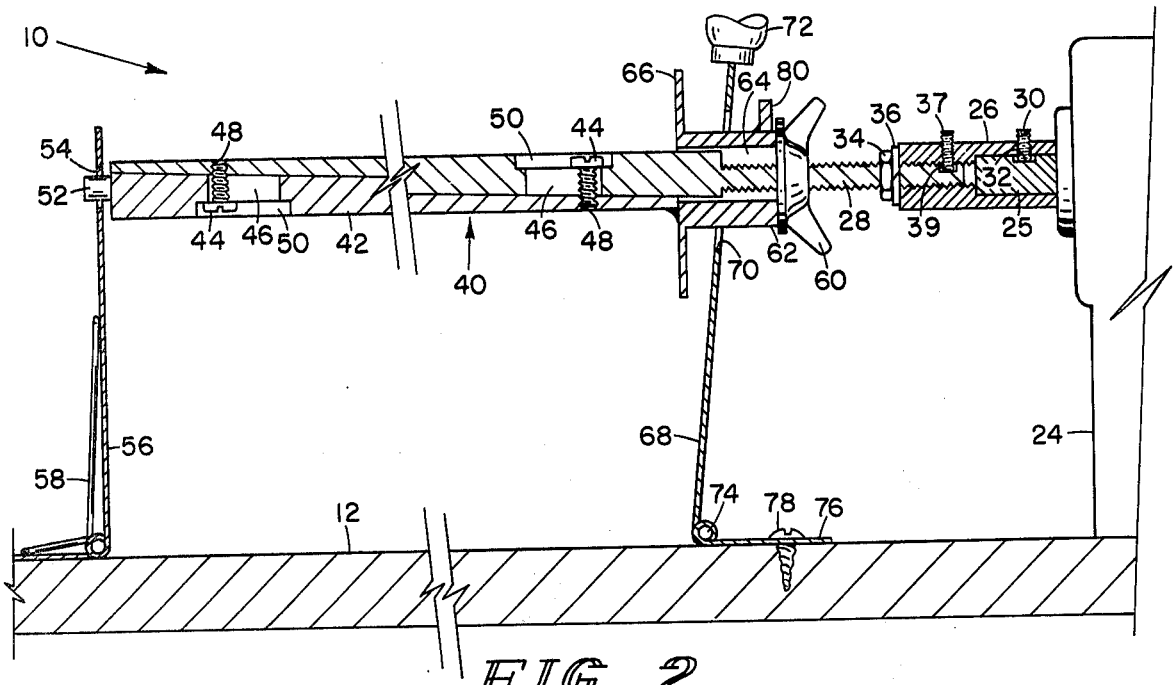
FIG. 2 is a partial cross-sectional view of FIG. 1 along section lines 2—2.

Rigidly mounted on the work surface 12 is a motor 22 held in position by motor support 24. Motor support 24 may be attached to work surface 12 by any suitable means. Referring to FIG. 2 in combination with FIG. 1, a shaft 25 of the motor 22 is connected to retaining ring 26 by means of set screw 30 threadably connected through retaining ring 26 to flat surface 32 of shaft 25.

Threadably received inside of retaining ring 26 is threaded shaft 28 that is secured in position by nut 34 and washer 36. Also set screw 37 seats against flat surface 39 of threaded shaft 28 to prevent unscrewing of threaded shaft 28 from retaining ring 26. Connected to an opposite end of the threaded shaft 28 is a first longitudinally tapered half 38 of a rectangular shaft 40. A second longitudinally tapered half 42 of the rectangular shaft 40 is slideably connected to the first longitudinally tapered half 38 by means of screws 44 extending through slots 46 for threadable connection with threaded holes 48. The heads of screws 44 are located in slotted recesses 50.

On the thick end of the second longitudinally tapered half 42 is a circular tab 52. The circular tab 52 is designed to be received inside of hole 54 of spring loaded hinge 56 mounted on work surface 12. Spring 58 constantly urges spring loaded hinge 56 to the upright position as shown in FIGS. 1 and 2.

Also threadably connected on the threaded shaft 28 is a wing nut 60 which is in an abutting relationship with a rectangular channel member 62. The rectangular channel member 62 has a rectangular opening 64 for receiving the large end of the first longitudinally tapered half 38 therein. Connected on the end of the rectangular channel member 62 receiving the first longitudinally tapered half is a circular flange 66 which is used to abutt and determine the thickness of each paper log being formed on the paper log forming apparatus 10. While the rectangular channel member 62 may be free floating about threaded shaft 28 and the first longitudinally tapered half 38, in this preferred embodiment the rectangular channel member 62 is connected to the small end of the second longitudinally tapered half 42 by any suitable means, such as welding.

Encircling the rectangular channel member 64 via hole 70 is a prying member 68. On a first end of the prying member 68 is located a prying handle 72. The second end of the prying member 68 is pivotally connected through hinge pin 74 and stationary hinge member 76 by screws 78 to work surface 12. By moving the prying handle 72 to the left, it will push against circular flange 66 thereby forcing the second longitudinally tapered half 42 to the left a distance provided in slots 46. By moving the prying handle 72 back to the right, it will abutt tab 80 to return the rectangular channel member 62 and the second longitudinally tapered half 42 to the position as shown in FIG. 2.

Figure 3:
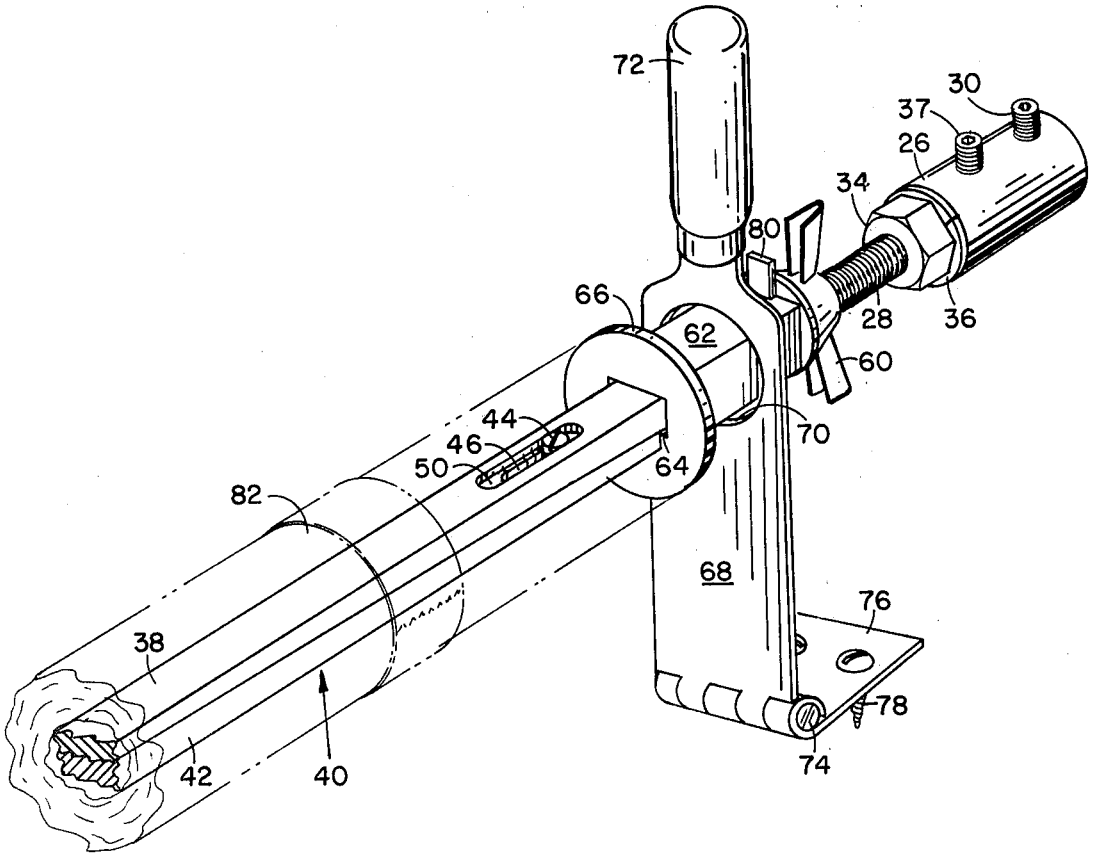
FIG. 3 is an enlarged perspective view of a first end of a rectangular shaft for connection to a motor.

Referring now to FIG. 3 of the drawings, there is shown an enlarged perspective view of the right end of the rectangular shaft 40 previously shown in FIGS. 1 and 2, which right end is normally connected to the motor 22. Once a roll of paper 82 (shown in reference lines) has been formed on the rectangular shaft 40, by moving the prying handle 72 to the left, prying member 68 will engage circular flange 66. Movement of circular flange 66 to the left by prying member 68 will also move the rectangular channel member 62 and the second longitudinally tapered half 42 to the left. As the second longitudinally tapered half 42 moves to the left, the cross-sectional area of the rectangular shaft 40 is reduced thereby allowing the roll of paper 82 to be easily slid along rectangular shaft 40 to the left.

Figure 4:
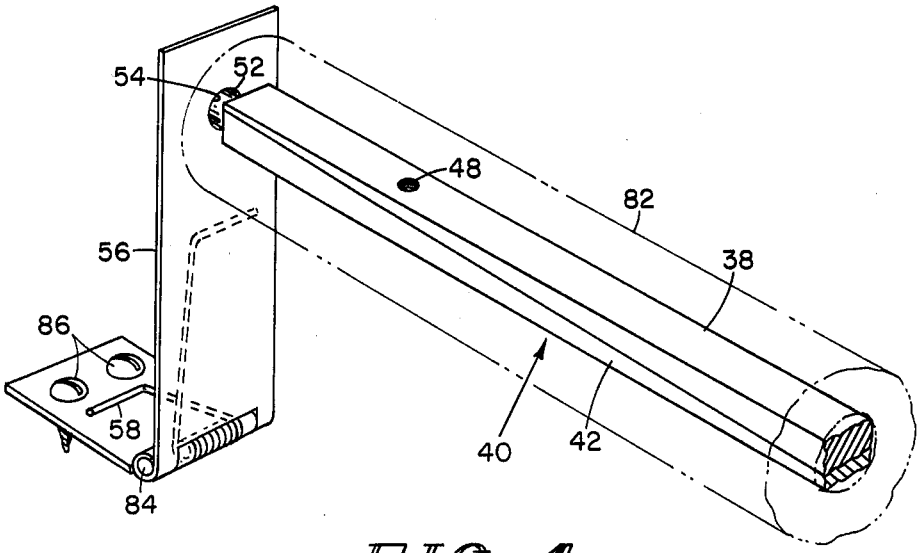
FIG. 4 is an enlarged perspective view of a second end of a rectangular shaft that is supported by a hinged member.

Referring to FIG. 4, as the roll of paper 82 is moved to the left, it will pivot the spring loaded hinge 56 about hinge pin 84 to remove circular tab 52 from hole 54 thereby allowing the roll of paper 82 to be slid off of the left end of the rectangular shaft 40. The spring loaded hinge 56 is held in position by screws 86 threadably connected to the work surface 12.

Figure 5:
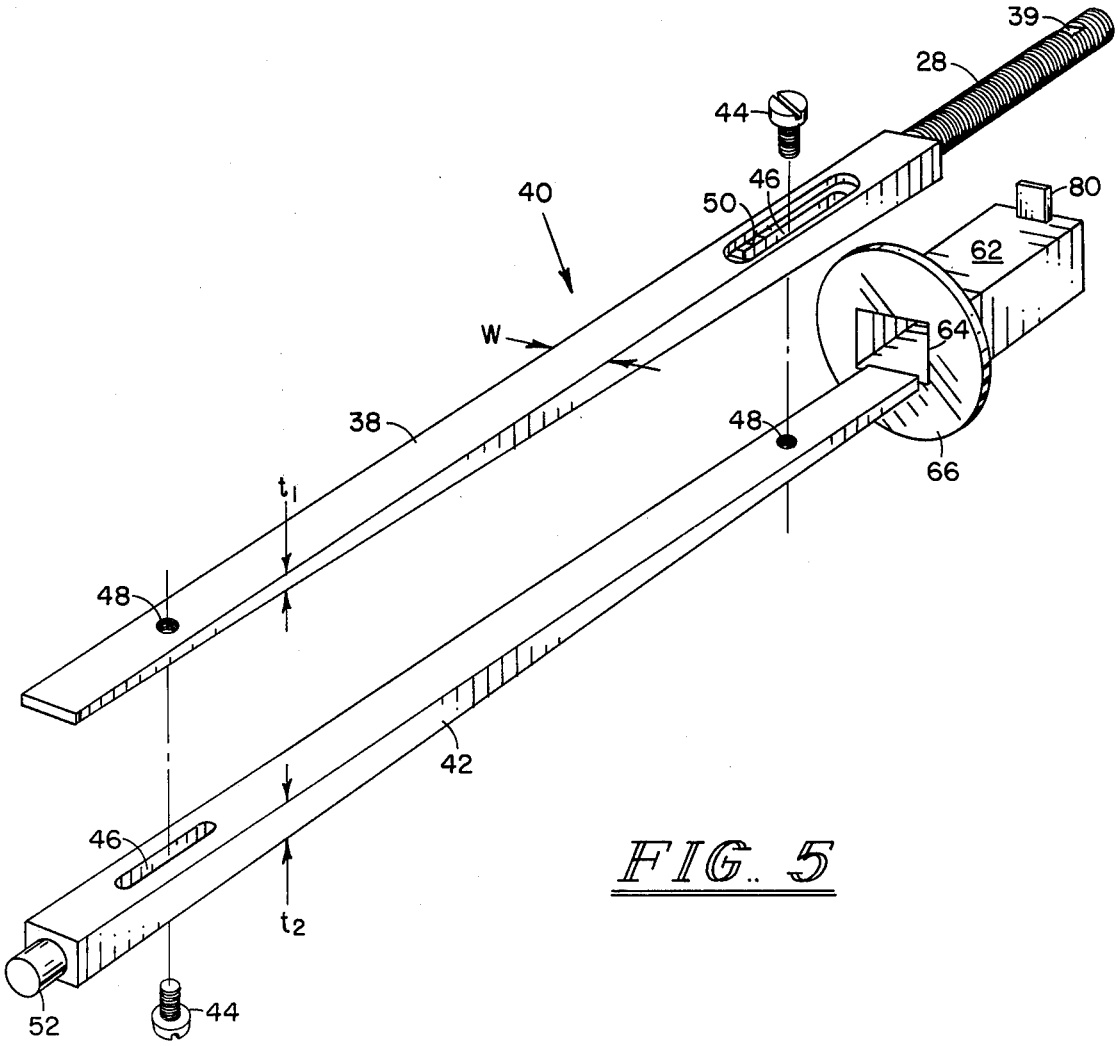
FIG. 5 is an exploded perspective view of the rectangular shaft portion.

Referring now to FIG. 5, there is shown an exploded perspective view of the rectangular shaft 40 with the connecting portions on each end thereof. As can be seen in the perspective view of FIG. 5, when the first and second longitudinally tapered halves 38 and 42, respectively, are connected together by screws 44, they may slide with respect to one another along their longitudinal axes a distance equal to the length of slots 46. As the second longitudinally tapered half 42 is moved to the left with respect to the first longitudinally tapered half 38, the thickness t of the rectangular shaft 40 is decreased. The thickness t is given as follows:

$$t = t_1 + t_2,$$

wherein $t_1$ is the thickness of the first longitudinally tapered half at any predetermined point along a vertical line perpendicular to the longitudinal axis of the rectangular shaft 40; and $t_2$ is the thickness of the second longitudinally tapered half along the same perpendicular line. As the second longitudinally tapered half 42 moves to the left with respect to the first longitudinally tapered half 38, the thickness t is decreased by decreasing $t_2$. Conversely, as the second longitudinally tapered 42 moves to the right with respect to the first longitudinally tapered half 38, the thickness t is increased by increasing $t_2$. The Width W for the rectangular shaft 40 and the first and second longitudinally tapered halves 38 and 42, respectively, remains unchanged along the longitudinal axis.

METHOD OF OPERATION

In the forming of paper logs on the apparatus 10, it is desirable to use unfolded sheets of paper because folds in the paper prevent a tightly rolled paper log. By taking a series of sheets of paper from any supply, such as the storage shelf 20, the first series of papers are rolled on the rectangular shaft 40 by the operation of the motor 22 via foot-operated switch 88 which connects to the motor 22 and the suitable source of electric power via cord 90. As the rectangular shaft 40 rotates, the sheets of paper are wound thereon. A feeding board is pivotally mounted on the work surface 12 by means of rod 94 extending therethrough and through eyelets 96. The feeding board 92 feeds the paper being rolled on the rectangular shaft 40.

As an alternative, the feeding board 92 may be pivotally mounted on the work surface 12 by any suitable means, such as a hinged connection (not shown). By use of springs between the feeding board 92 and the work surface 12, the feeding board 92 can be maintained against the paper being rolled into paper logs thereby resulting in an evenly fed, tight roll of paper.

Periodically as the paper is rolled on rectangular shaft 40, a suitable paper tape, such as masking tape 98, is wrapped around the paper log being formed. Through experimentation, applicant has found that approximately two wraps of the masking tape 98 toward each end of the paper log at approximately equally spaced intervals are necessary so that the paper log 82 will be tight. As the paper log 82 reaches a diameter approximately equal to the diameter of the circular flange 66, the paper log is complete upon a final wrapping therearound by the masking tape 98. By the cutting or the tearing of the masking tape 98 by any convenient means, the paper log 82 may now be removed by moving the prying handle 72 to the left. As soon as the second longitudinally tapered half 42 is moved to the left, the paper log 82 is loosened on the rectangular shaft 40 and may be slid to the left with spring loaded hinge 56 pivoting downward out of the way. Thereafter, spring loaded hinge 56 springs back into place to receive circular tab 52 in hole 54 thereof.

While any convenient means for dispensing the masking tape 98 may be used, applicant has found particularly suitable the mounting of two brackets 100 on work surface 12 for pivotally retaining masking tape 98 on rollers 102. Dispensing rollers 104 are pivotally mounted on dispensing brackets 106 in front of rollers 102. The masking tape 98 sticks to the dispensing rollers 104 thereby maintaining the masking tape 98 immediately adjacent to the roll of paper 82 being formed on the rectangular shaft 40. By simply sticking the masking tape 98 to the roll of paper 82 being formed, and operating the foot-operated switch 88, the motor 22 will turn the rectangular shaft 40 with the roll of paper 82 thereon. After one complete revolution, the masking tape 98 is either cut or torn by any convenient means. By using the dispensing system as just described, the masking tape 98 is always within easy reach of the operator and immediately adjacent to the roll of paper 82.

I claim:

1. An apparatus for forming paper logs from sheets of paper comprising:

a work surface;

motor means stationarily mounted with respect to work surface;

shaft means connected to and turned by said motor means, said shaft means extending over said work surface, said shaft means having a first and second longitudinally tapered half, said first longitudinally tapered half being longitudinally stationary, said second longitudinally tapered half being slideably attached to said first longitudinally tapered half with a taper therebetween and slideable along an axis of said shaft means, movement of said second longitudinally tapered half in a first direction along said axis increasing cross-sectional diameter of said shaft means and movement in a second direction along said axis decreasing said cross-sectional diameter of said shaft means; said sheets of paper being wrapped around said shaft means turned by said motor means to form said paper logs.

2. The apparatus as given in claim 1 comprising a moveable support means attached to said work surface for rotably supporting a second end of said shaft means, a first end of said shaft means being connected to said motor means.

3. The apparatus as given in claim 2 wherein said moveable support means is spring loaded to allow said paper log formed on said shaft means to be slideably removed from said second end of said shaft means by pivoting said moveable support means.

4. The apparatus as given in claim 3 comprising tape dispensing means attached to said work surface, said tape dispensing means periodically supplying tape to said sheets of paper forming said paper log.

5. The apparatus as given in claim 2 wherein said shaft means is generally rectangular with slots in said first and second longitudinally tapered halves, said slots having connecting means extending therethrough for slideably connecting said halves together.

6. The apparatus as given in claim 5 comprising prying means pivotally connected to said work surface, said prying means being constructed and arranged to engage and slide said second longitudinally tapered half in said second direction to decrease said cross-sectional diameter of said shaft means.

7. The apparatus as given in claim 6 comprising a collar around said shaft means for said engaging and sliding of said second longitudinally tapered half, said collar surrounding a threaded shaft connected to an end of said first longitudinally tapered half and said motor means, nut means on said threaded shaft for aiding said prying means.

8. A method of forming paper logs from sheets of paper consisting of the following steps:

energizing a motor to turn a shaft connected thereto, said shaft having a first and second longitudinally tapered half slideably connected together along a taper therebetween;

feeding said sheets of paper to said turning shaft for rotation thereon;

periodically taping said sheets of paper to maintain a tight roll on said turning shaft;

first sliding said second longitudinally tapered half in a first direction along said taper to reduce cross-sectional diameter of said shaft; and second sliding of said paper log formed by said sheets of paper off a first end of said shaft.

9. The method given in claim 8 wherein said first sliding step includes pushing against an end of said second longitudinally tapered half by a prying means.

10. The method given in claim 9 wherein said first sliding step further includes nut means connected on a threaded portion of a second end of said shaft, said nut means being constructed and arranged to aid said prying means in pushing against said second longitudinally tapered half.

11. The method given in claim 8 including a first step of moving said second longitudinally tapered half in a second direction along said taper to increase cross-sectional diameter of said shaft.

12. The method given in claim 11 wherein said second sliding step includes pivoting support means away from said first end of said shaft as said paper log is removed, said support means being spring loaded to return to support said first end of said shaft after removal of said paper log.

* * * * *